US006978754B2

(12) United States Patent
Cicone

(10) Patent No.: US 6,978,754 B2
(45) Date of Patent: Dec. 27, 2005

(54) MANIFOLD SENSOR RETENTION SYSTEM

(75) Inventor: Nick A. Cicone, Rochester Hills, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 42 days.

(21) Appl. No.: 10/631,128

(22) Filed: Jul. 31, 2003

(65) Prior Publication Data

US 2005/0022771 A1 Feb. 3, 2005

(51) Int. Cl.[7] ..... F02M 35/10
(52) U.S. Cl. ..... 123/184.21; 403/348; 439/913
(58) Field of Search ..... 123/184.21; 403/348, 403/349; 439/913

(56) References Cited

U.S. PATENT DOCUMENTS 5,123,795 A 6/1992 Engel et al.
RE34,381 E 9/1993 Barnes
5,342,126 A 8/1994 Heston et al.
6,422,205 B2 7/2002 Wynn, Jr. et al.
6,571,782 B2 * 6/2003 Brosseau et al. ..... 123/568.18
6,579,030 B2 * 6/2003 Uhler et al. ..... 403/348

* cited by examiner

*Primary Examiner*—Henry C. Yuen
*Assistant Examiner*—Katrina Harris
(74) *Attorney, Agent, or Firm*—Ralph E. Smith

(57) ABSTRACT

A system for retaining a sensor on an injection molded intake manifold that uses a twist-lock connection within the receiving port. The sensor body has outwardly projecting lugs that pass between inwardly projecting lugs in the receiving port. The face of the manifold is formed with external guiding projections around the receiving port that direct insertion of the sensor into the receiving port in a specific first, unlocked orientation, and permit rotation of the sensor to a second, locked orientation. After the sensor is rotated to the locked orientation, attachment of an external connector, such as a wire harness, prevents the sensor from being rotated back to the first, unlocked orientation by interfering with the external guiding projections.

8 Claims, 7 Drawing Sheets

MANIFOLD SENSOR RETENTION SYSTEM

CROSS-REFERENCE TO RELATED APPLICATIONS

Not applicable.

STATEMENT REGARDING FEDERALLY SPONSORED RESEARCH

Not applicable.

BACKGROUND OF THE INVENTION

1. Field of the Invention

The invention relates to a system for fluidly connecting and retaining a sensor to an intake manifold of an internal combustion engine.

2. Description of Related Art

Internal combustion engines have an intake manifold. The intake manifold can be formed of any of a number of materials, such as aluminum, but today are more commonly injection molded from a plastic or other composite material.

These composite materials have the advantage of light weight, low cost, and sufficient tensile strength for withstanding the normal loads imposed upon them. A disadvantage lies, however, in their ability to withstand the fine shearing forces created in bolting components directly to the composite, as in forming or tapping threads in the composite that must withstand bolt tightening torque. This weakness of composites has traditionally been overcome by the use of internally threaded metallic sleeves, press-fit into wells or apertures formed in the surface of the molded part. The attached components are then attached to the molded part with fasteners threaded into the metallic sleeves, or the component itself has external threads for mating with the sleeve.

These methods also have a percentage of failures as the press-fit sleeve sometimes breaks loose of the molded part, coming completely loose or at least causing a leak. In some applications, an attached component requiring a sealing connection with the molded part is attached to the manifold with fasteners on each side of the component. Uneven or sideways forces on the connectors can cause the seal between the attached component and the molded part to leak. So, while this method can overcome the weakness of the molded part in retaining attached components, it also introduces other failure modes. It also weighs against the advantage found in the lower weight, and, especially, the lower cost of the single injection molded part.

It would therefore be advantageous to develop an alternative method of attaching components to an injection molded part, such as an intake manifold. Such a method would take advantage of the flexibility of injection molding, and would avoid the requirement for additional fixtures for securely but removably attaching components to the injection molded part. This method would also avail a sealing attachment of such components to the molded part. This method would also be adaptable to a part formed or machined by a method other than injection molding.

BRIEF SUMMARY OF THE INVENTION

In combination, an attachment and a receiving attachment port, the configuration of the attachment port in the injection molded intake manifold of an internal combustion engine, the port including a pass through cylindrical aperture, at least one inwardly projecting lug in the aperture, the port being surrounded on the external surface of the manifold by a plurality of projections for aligning the attachment for insertion into the port, and preventing inadvertent removal from the port, the attachment including at least one externally projecting lug for cooperating with the internally projecting lug of the port for positively locking the attachment within the port.

BRIEF DESCRIPTION OF THE SEVERAL VIEWS OF THE DRAWINGS

The present invention will become more fully understood from the detailed description and the accompanying drawings, wherein.

DETAILED DESCRIPTION OF THE INVENTION

Referring to FIGS. 1–4, a manifold sensor retention system 10 is comprised of a reception port 110 formed in the manifold 100, and a sensor 200 configured for mounting with the sensor port 110.

Figure 1:
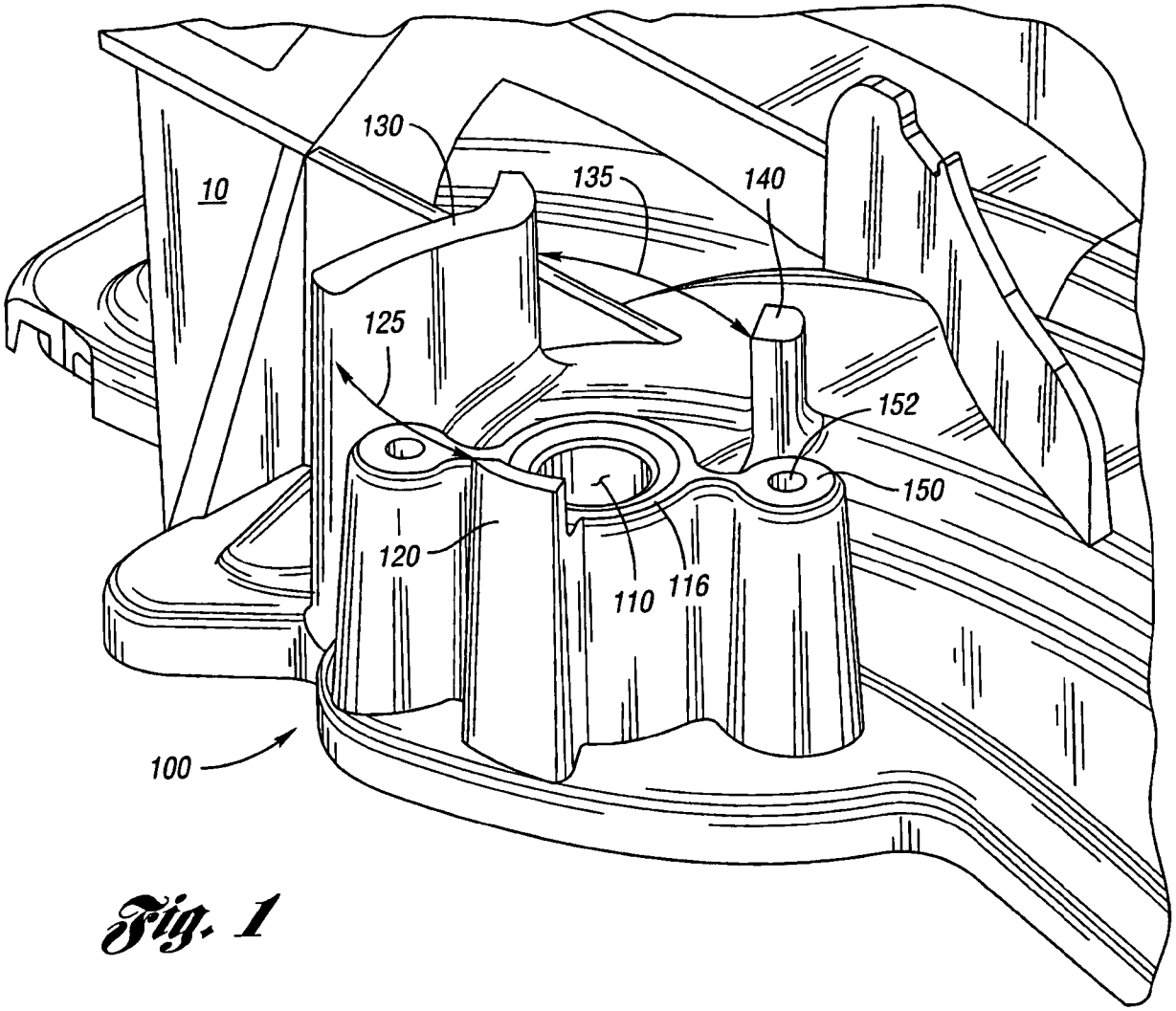
FIG. 1 is a perspective view of a reception port of a manifold sensor retention system according to the invention.
Figure 2:
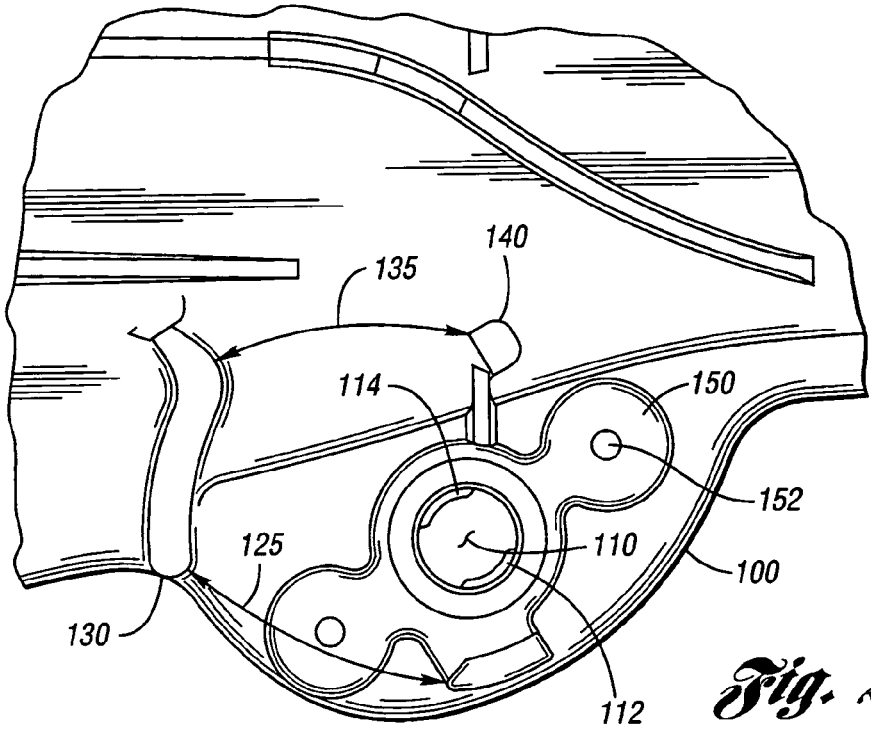
FIG. 2 is a plan view of reception port of FIG. 1.

With particular reference to FIGS. 1–2, port 110 is generally cylindrical and extends from the face of the manifold 100. Port 110 has a flat external surface 116. The inner cylindrical surface of port 110 includes a pair of inwardly extending lugs 112, 114 (see FIG. 2). In the illustrated embodiment, the lugs 112, 114 are diametrically opposed and each occupy approximately 90 degrees of the circumference of the cylindrical surface, having a 90 degree separation therebetween. A pair of pillars 150 are formed on either side of port 110, having a formed aperture 152, for securing a sensor with external fasteners according to the prior art. The formed manifold 100 is thus adaptable to accepting a sensor 200 according to the invention, or a conventional sensor according to the prior art.

A raised first insertion guide 120 is formed on one side of port 110. First insertion guide 120 is formed integrally and extends above the flat external surface 116 of port 110. A second insertion guide/removal stop 130 is formed along another side of the port 110, separated by the first insertion guide 120 by an insertion region 125. As will be evident, the insertion guides 120, 130 provide a ready reference for an installer to insert the sensor 200 (see FIG. 3) into the port 110 according to the invention. Second insertion guide/removal stop 130 also extends above the surface 116 of the port 110.

A third raised portion of the manifold 100, in the form of a rotation stop 140, is positioned circumferentially further around the port 110 from the second insertion guide/removal stop 130. The rotation stop 140 also extends from the manifold 100 further than the face 116 of the port 110. A locking region 135 is defined between the rotation stop 140 and the removal stop 130.

Figure 3:
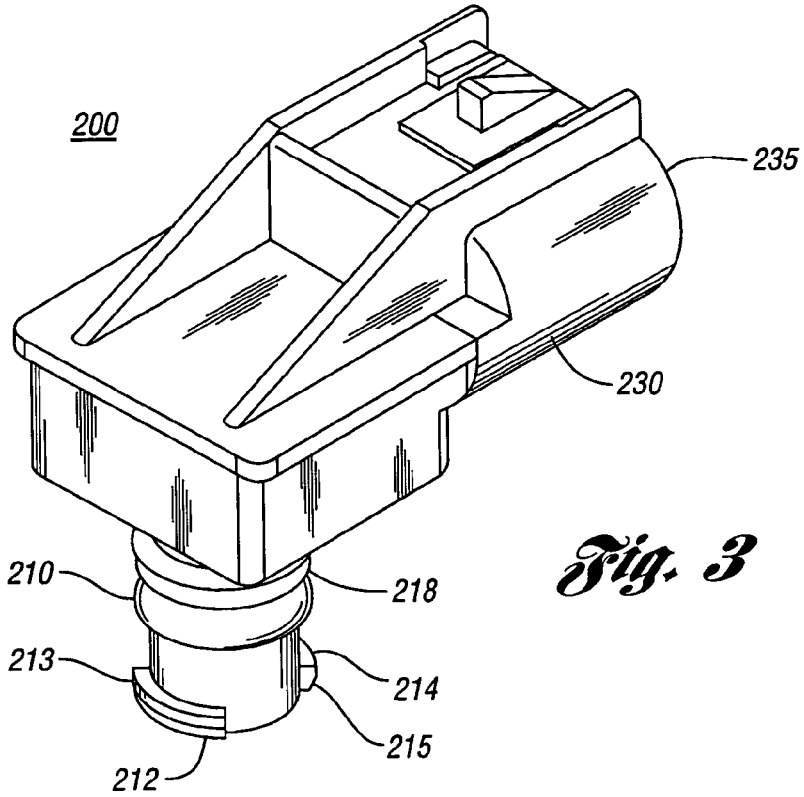
FIG. 3 is a perspective view of a sensor for insertion into the reception port of FIGS. 1–2.
Figure 4:
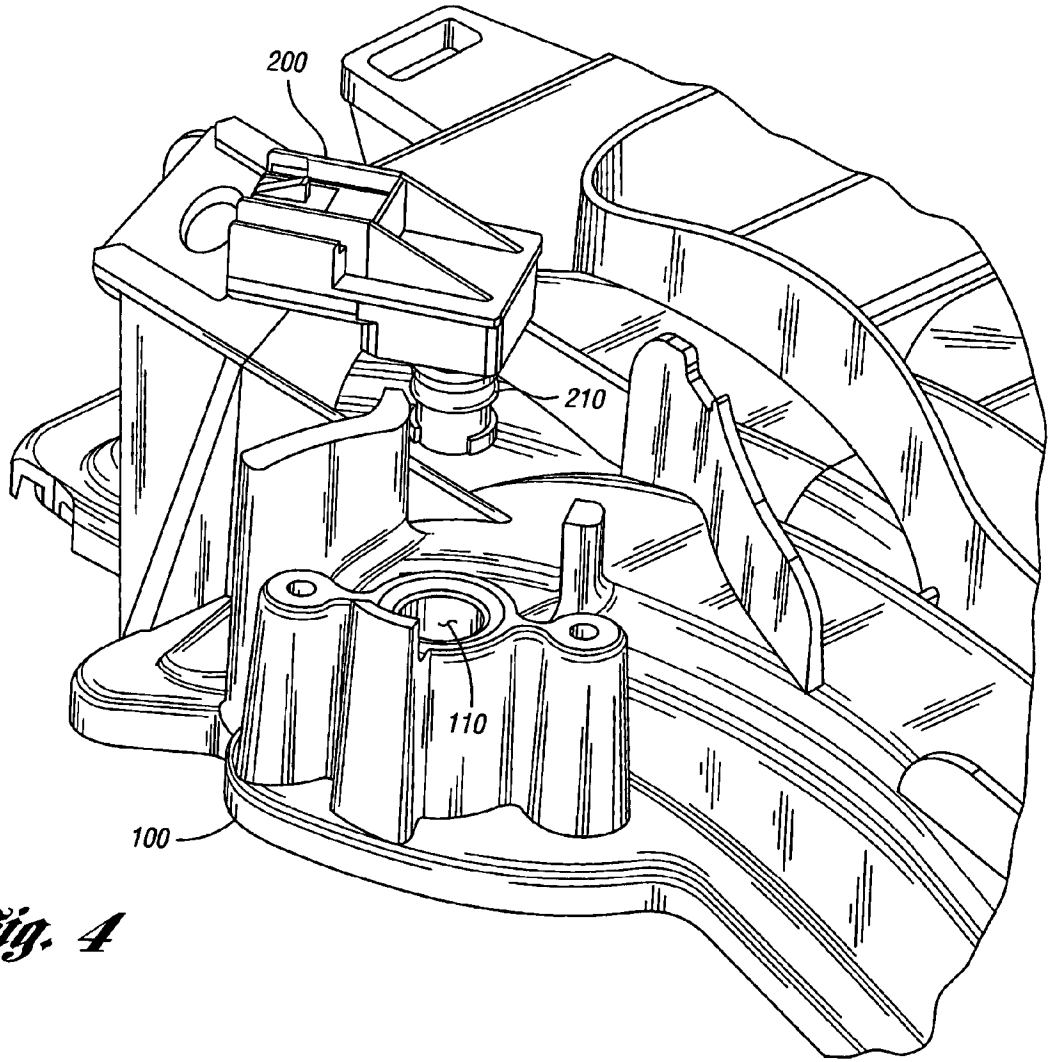
FIG. 4 is a perspective view of the sensor of FIG. 3 poised for insertion into the reception port of FIGS. 1–2.
Figure 8:
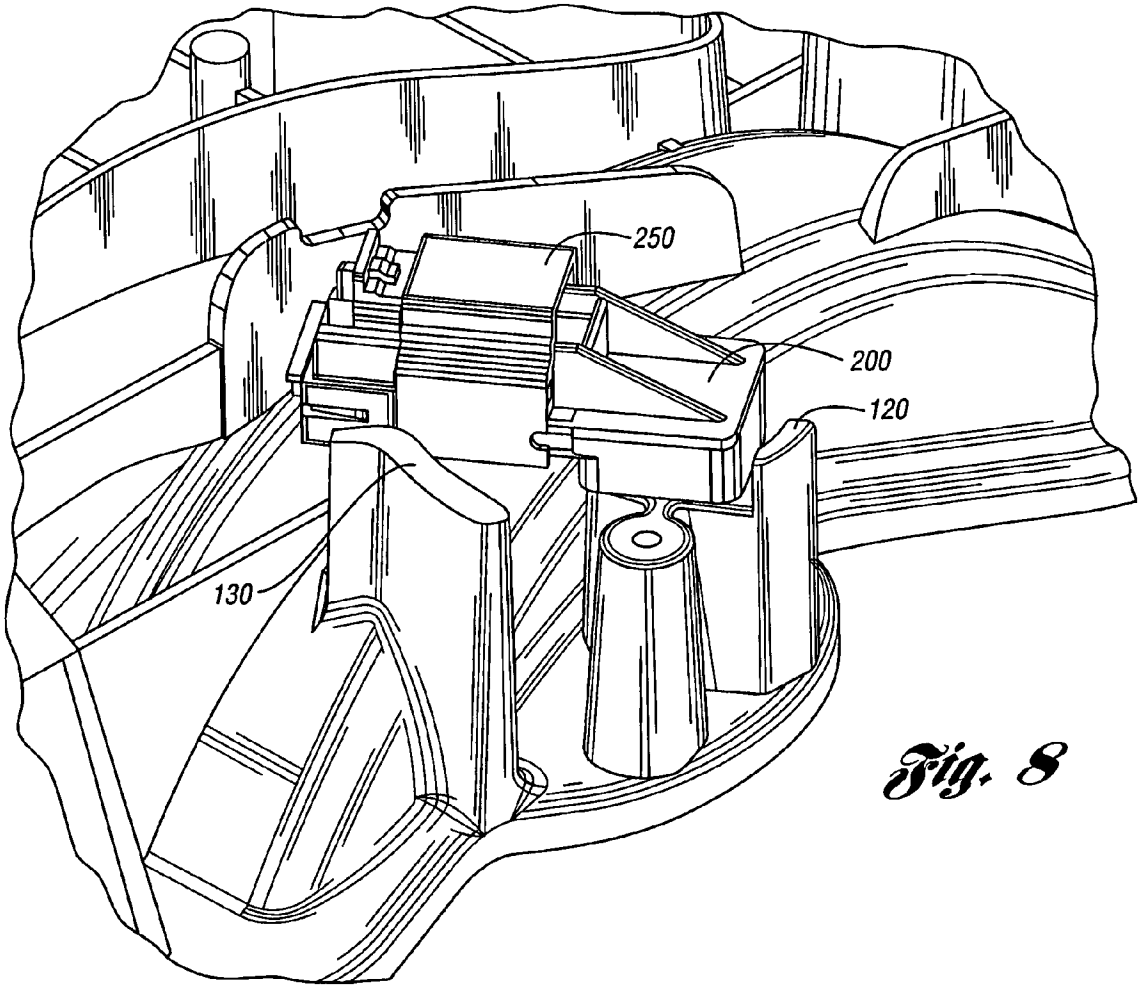
FIG. 8 is a perspective view of the sensor and reception of FIGS. 6–7, with an external wire connector attached to the sensor.

Referring now to FIG. 3, the sensor 200 according to the invention includes an insertion portion 210 for insertion into the port 110, and an external portion 230 including a connection interface 235 for attachment of an external connector such as a wire connector 250(see FIG. 8).

The insertion portion 210 is cylindrical and sized for ready insertion into port 110. An o-ring 218 is provided on the insertion portion to form a seal between the insertion portion 210 and the port 110. A pair of lugs 212, 214 are formed on the end of the insertion portion 210, and extend radially outwardly from a longitudinal axis of the cylindrical insertion portion 210. The lugs 212, 214 are each shown as spanning an arc of approximately 90 degrees of the circumference of the insertion portion 210, and are configured to cooperate with the lugs 112, 114 found in the port 110 for retaining the sensor 200 in the port 110. A leading edge 213, 215 of each lug 212, 214 is shown as being tapered or ramped to allow for the lugs 112, 114, 212, 214 to readily slide over one another.

With reference now to FIGS. 4–7, the sensor 200 is aligned over the port 110 so that the insertion portion 210 can be inserted into port 110 in the longitudinal or axial direction. The external portion 230 is aligned over the insertion region 125, preferably abutting the insertion guide 120. The lugs 112, 114 in the port 110, and the lugs 212, 214 on the insertion portion 210 of the sensor 200, are arranged so that when the external portion 230 of the sensor 200 is aligned in the insertion region 125, the lugs do not interfere with the full insertion of the insertion portion 210 into port 110.

Figure 5:
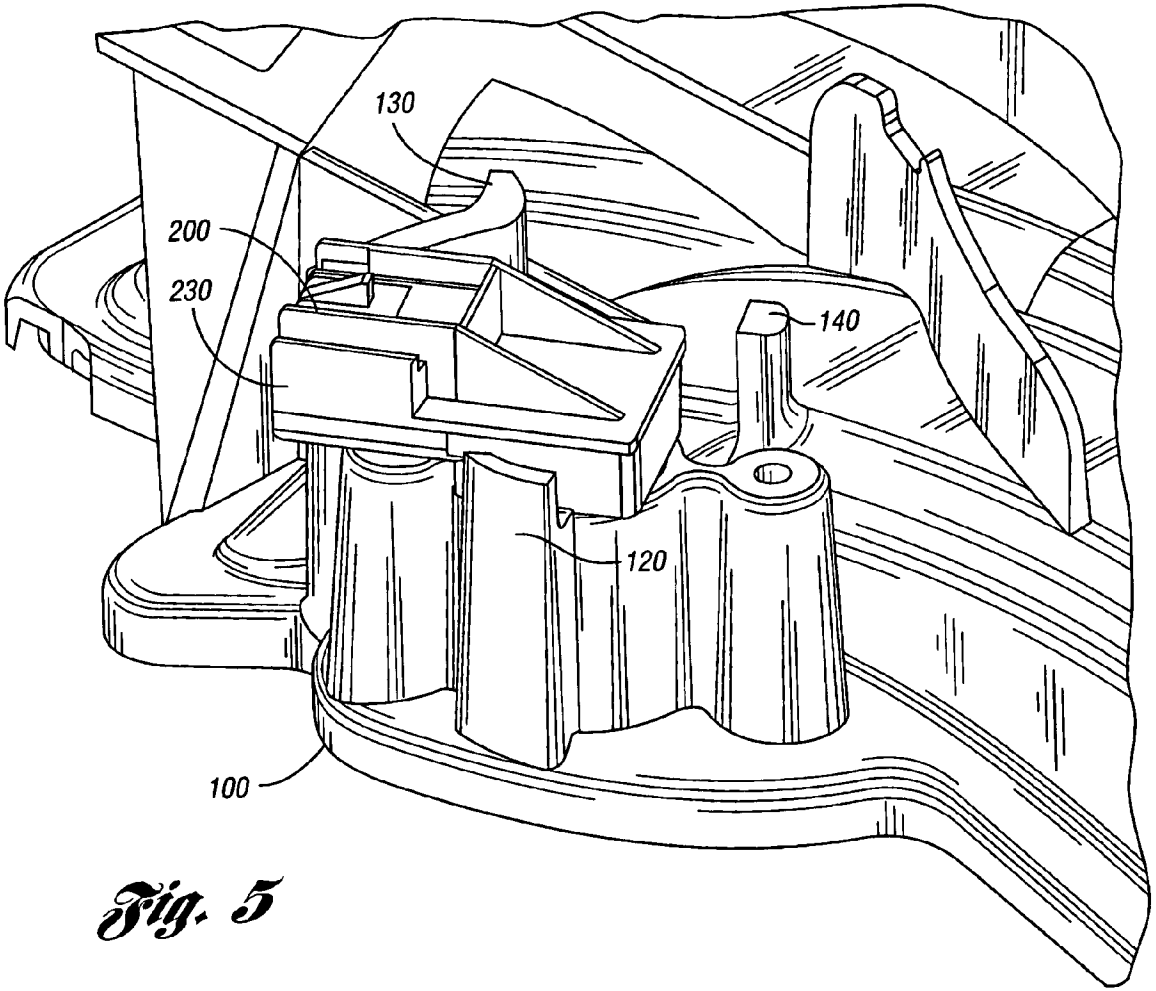
FIG. 5 is a perspective view of the sensor of FIG. 3 in the reception port in an insertion orientation.
Figure 6:
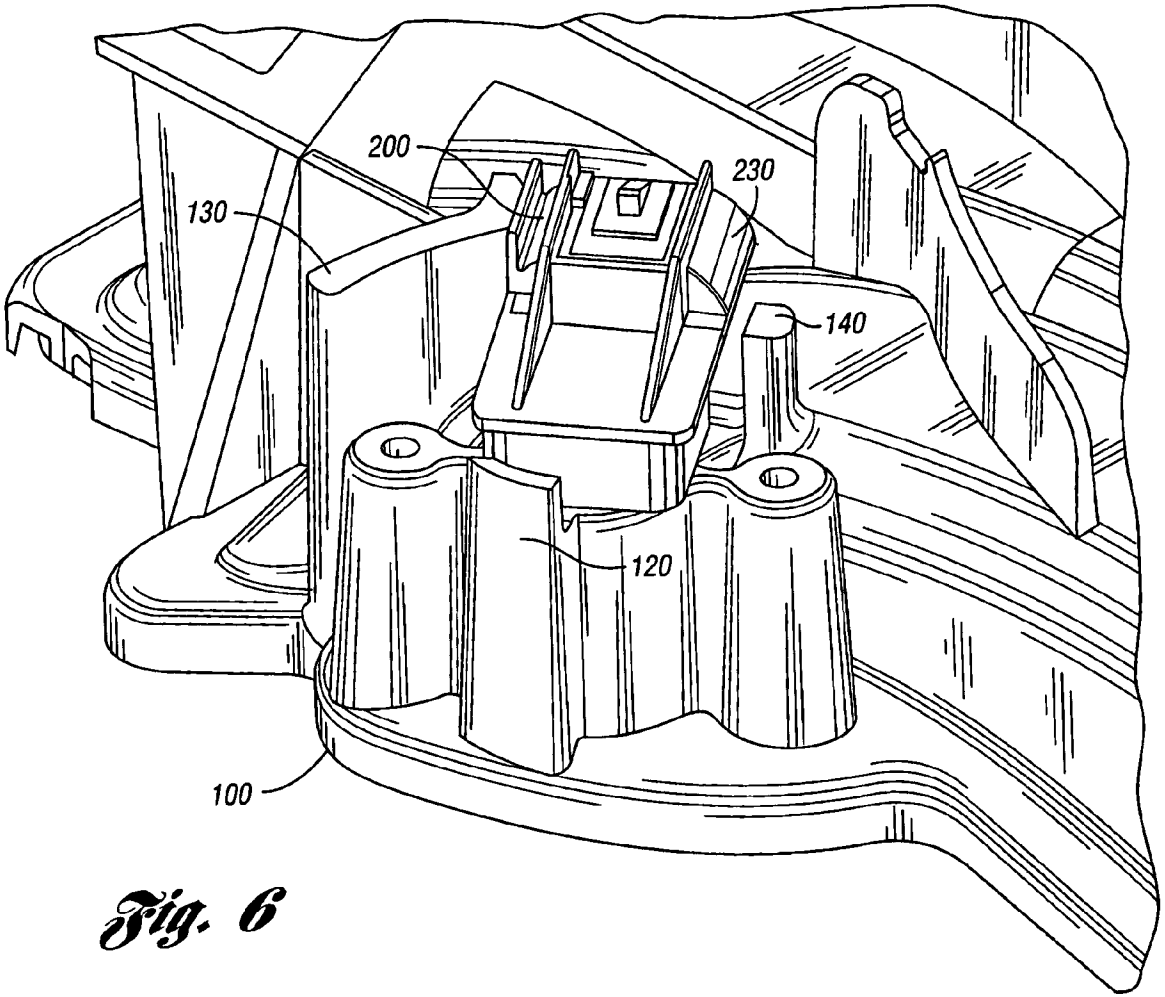
FIG. 6 is a perspective view of the sensor and reception port of FIG. 5, the sensor being rotated to a locked orientation.
Figure 7:
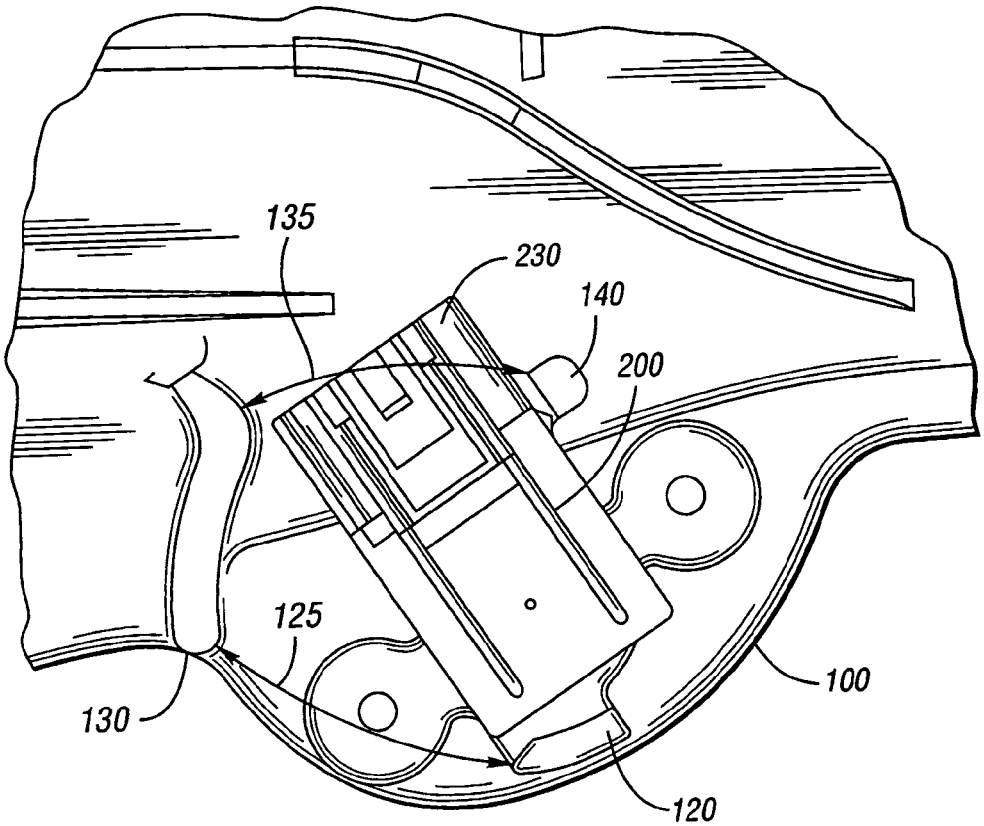
FIG. 7 is a plan view of the sensor and reception port of FIG. 6.

With the insertion portion 210 fully inserted in port 110, external portion 230 will be flush against surface 116 and substantially against insertion guide 120, as shown in FIG. 5. Lugs 212, 214 will be circumferentially positioned between lugs 112, 114, but will have passed between lugs 112, 114 so as to be positioned further inside port 110. Thus, as sensor 200 is rotated about the longitudinal axis of insertion portion 210 to a locking position (see FIG. 6), lugs 212, 214 will be trapped behind lugs 112, 114.

Once inserted fully into port 110, sensor 200 can be rotated from the insertion region 125 to the locking region 135. Second insertion guide/removal stop 130 is spaced from port 110 a sufficient distance that external portion 230 of sensor 200 can pass closely to its inside surface. The sensor 200 can only rotate until external portion 230 abuts rotation stop 140. At this point in the rotation, lugs 112, 114, 212, 214 are substantially engaged to retain sensor 200 within port 110.

Referring now to FIG. 8, the sensor 200 is connected to an external system for receiving output from the sensor. As shown, a conventional locking cable connector 250 is removably attached to the connection interface 235 of external portion 230. With the cable connector 250 attached, the sensor 200 cannot be rotated back to the insertion region 125 for removal, as the attached cable connector 250 extends beyond the external portion 230 so as to interfere with rotation through the second insertion guide/removal stop 130. The sensor 200 is therefore rotationally trapped between removal stop 130 and rotation stop 140. If the sensor 200 requires removal for service or replacement, the cable connector 250 can be removed and the external portion 230 of the sensor 200 rotated to the insertion region 125, wherein the lugs 112, 114, 212, 214 will be clear from one another to allow for removal of sensor 200.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the scope of the appended claims.

What is claimed is:

1. In combination, a manifold and a sensor, the manifold having a port for receiving the sensor, and external projections adjacent the port for aligning the sensor for insertion into the port and for preventing removal from the port, the port having diametrically opposed, radially inwardly projecting lugs, each lug having a ramped lading edge;

the sensor having an insertion portion and a cable connection interface portion, the insertion portion and the cable connection interface portion being at right angles to one another; the insertion portion having a profile matching the port, and having diametrically opposed, radially outwardly projecting lugs, each lug having a ramped leading edge;

whereby the insertion portion of the sensor is adapted to be inserted into the port of the manifold in an insertion position with the lugs out of alignment, and whereby the sensor is further adapted to be rotated so that the ramped portions of the lugs engage to draw the sensor into a seated position as the cable connection interface portion of the sensor abuts one of the external projections in the form of a rotation stop, and whereby the sensor is prevented from rotating back to the insertion position by another of the external projections in the form of an anti-rotation projection when a cable is connected to the cable connection interface portion.

2. An insert retention system comprising in combination:

an insertion port formed in a body and having at least one inwardly extending projection;

an insert including:

an insertion portion having a longitudinal axis and at least one radially outwardly extending projection, the insertion portion adapted for insertion into the insertion port in a first orientation wherein the radially outwardly extending projection is not rotationally aligned with the inwardly extending projection, and rotation to a second orientation wherein the projections are rotationally aligned; and an external connection interface extending radially outwardly from the longitudinal axis;

and a plurality of material formations extending from the body adjacent the insertion port, the material formations adapted to obstruct rotation of the insert from the second orientation to the first orientation upon attachment of an external connection to the external connection interface.

3. The system of claim 2, wherein the external connection interface is joined to the insertion portion at a right angle.

4. The system of claim 2, wherein the at least one radially outwardly extending projection comprises two diametrically opposed radially outwardly extending projections and the at least one radially inwardly extending projection comprises two diametrically opposed extending projections.

5. The system of claim 2, wherein the material formations are further adapted for receiving the connection interface therebetween for aligning the insert in the insertion port in the first orientation.

6. A method of attachment of a sensor to a wall of a fluid chamber, comprising:

providing a passage through the wall into an interior of the fluid chamber, the passage having at least one radially inwardly projecting lug;

providing a sensor having a condition sensing portion adapted for reception in the passage for fluid connection to the interior of the fluid chamber and an external system connecting portion, the condition sensing portion having a longitudinal axis and at least one radially outwardly projecting lug;

providing a plurality of outward projections including at least one rotation stop and at least one anti-rotation projection formed on an outer surface of the wall adjacent the passage inserting the condition sensing portion into the passage in a longitudinal direction;

rotating the sensor about the longitudinal axis to engage the inwardly projecting lug with the outwardly projecting lug;

moving the inwardly projecting lug along the outwardly projecting lug until the sensor contacts the rotation stop;

attaching an external connection to the sensor; and engaging the external connection with the anti-rotation projection to prevent rotation of the sensor about the longitudinal axis and removal of the sensor from the passage.

7. The method of claim 6, wherein the external system connecting portion is joined to the condition sensing portion at a right angle.

8. The method of claim 6, wherein the at least one radially outwardly projecting lug comprises two diametrically opposed lugs and the at least one radially inwardly projecting lug comprises two diametrically opposed lugs, and wherein rotating the sensor moves the inwardly and outwardly projecting lugs from a non-aligned condition to an aligned condition.

* * * * *